US005292220A

United States Patent [19]

Cartner

[11] Patent Number: 5,292,220

[45] Date of Patent: Mar. 8, 1994

[54] DUAL CYLINDER ACTUATED BOOM ARM

[76] Inventor: Jack O. Cartner, 1005 N. 8th St., Cambridge, Ohio 43725

[21] Appl. No.: 865,912

[22] Filed: Apr. 9, 1992

Related U.S. Application Data

[63] Continuation of Ser. No. 635,364, Dec. 28, 1990, abandoned.

[51] Int. Cl.[5] ..... E02F 9/24

[52] U.S. Cl. ..... 414/687; 91/401

[58] Field of Search ..... 414/687, 690, 694, 695.5, 414/730; 172/200.5; 91/401, 170 R, 517

[56] References Cited

U.S. PATENT DOCUMENTS

| | | | |
|---|---|---|---|
| 4,048,789 | 9/1977 | Cartner . | |
| 4,065,010 | 12/1977 | Worback | 414/694 |
| 4,095,436 | 6/1978 | Heitkamp et al. | 91/170 R X |
| 4,249,614 | 2/1981 | van der Lely | 172/261 |
| 4,442,658 | 4/1984 | Cartner . | |

*Primary Examiner*—Michael S. Huppert
*Assistant Examiner*—Donald W. Underwood
*Attorney, Agent, or Firm*—Fay, Sharpe, Beall, Fagan, Minnich & McKee

[57] ABSTRACT

A linkage mechanism which allows a substantially 180° pivoting motion of a frame, and hence a boom arm secured to the frame, around the frame's pivot axis includes a mast to which the frame is fixedly secured, the mast being pivotably mounted on a pivot axis to an associated support frame. A first hydraulic cylinder having a piston rod end and a cylinder end is pivotably secured at the piston rod end to a first side of the mast. A second hydraulic cylinder having, a piston rod end and a cylinder end is pivotably secured at the piston rod end to a second side of the mast. A control member is operatively associated with the first and second hydraulic cylinders for effecting a linear movement of the piston rods and hence a pivotal movement of the mast and thus the boom arm secured to the mast about the mast's pivot axis. At least one of the first and second hydraulic cylinders has overload protection such that the mast, and the frame and boom arm, will pivot around the pivot axis in the event an associated tool secured to the boom arm meets an obstruction. This avoids damage to the associated tool as well as the boom arm.

19 Claims, 12 Drawing Sheets

DUAL CYLINDER ACTUATED BOOM ARM

This application is a continuation of U.S. patent application Ser. No. 07/635,364 filed on Dec. 28, 1990, now abandoned.

BACKGROUND OF THE INVENTION

The present invention relates to earth working equipment. More particularly this invention relates to a boom arm pivoting linkage mechanism which is used on such an earth working device.

The invention finds particular application in the cleaning and maintaining of road shoulders or berms where vegetation needs to be cut or soil or debris need to be moved, and will be described with reference thereto. However, it should be appreciated that the invention also finds application in other boom arm environments.

Heretofore, road maintenance equipment, such as mowing apparatus, has been connected with prime movers such as tractors in various ways. Articulated boom assemblies have been found to be particularly advantageous for supporting mowing apparatus on tractors or the like. Such a boom assembly includes a plurality of arms, a first of which is pivotally connected with the tractor and a second of which is pivotally connected between the mowing apparatus and the first arm. Hydraulic cylinders are provided to control the angular orientation of the first arm relative to the tractor and the second arm relative to the first arm.

One particular known mechanism employs a pair of hydraulic cylinders in order to enable a pivoting motion of a boom arm, to which a rotary cutting mechanism was secured, over substantially 180° of motion. However, this mechanism was not tied in with a breakaway system so that if an obstruction is encountered by, e.g., an earth working device secured to the free end of a boom arm, the boom assembly could pivot the earth working device away from the obstruction before any damage would be caused to either the earth working device or the boom mechanism. In addition, the known mechanism is fairly large in size and is adapted only for use on a rear end of a construction vehicle.

Accordingly, it has been considered desirable to develop a new and improved linkage mechanism for a pivotable boom arm which would overcome the foregoing difficulties and others while providing better and more advantageous overall results.

BRIEF SUMMARY OF THE INVENTION

In accordance with the present invention, a new and improved linkage mechanism is provided which allows a substantially 180° pivoting motion of a frame, and hence a boom arm secured to the frame, around the frame's pivot axis.

More particularly in accordance with this aspect of the invention, the linkage mechanism comprises a mast to which the frame is fixedly secured. The mast is pivotably mounted on an pivot axis to an associated support frame. A first hydraulic cylinder, having a piston rod end and a cylinder end, is provided with one of the first hydraulic cylinder ends being pivotably secured to a first side of the mast. A second hydraulic cylinder having a piston rod end and a cylinder end is provided with one of the second hydraulic cylinder ends being pivotably secured to a second side of the mast. An overload protection circuit is operatively connected to at least one of the first and second hydraulic cylinders such that the mast and the boom arm will pivot around the pivot axis in the event that the associated tool meets an obstruction in order to avoid damaging the associated tool. Control means is operatively associated with the first and second hydraulic cylinders for effecting a linear movement of the piston rods and a pivotal movement of the mast and hence the boom arm secured thereto about the mast's pivot axis.

In accordance with another aspect of the present invention, a road maintenance vehicle construction is provided.

More particularly in accordance with this aspect of the invention, the vehicle comprises a support housing including a means for securing the housing to a vehicle and a mast which is rotatably secured to the housing. A frame is fixably secured to the mast. A boom member is attached at one end to the frame and adapted to hold a road maintenance tool at the other end. A first hydraulic cylinder having a piston rod end and a cylinder end is provided. The piston rod end being pivotably secured to a first side of the mast and the cylinder and being secured to a first side of the support housing. A second hydraulic cylinder having a piston rod end and a cylinder end is also provided. The second hydraulic cylinder piston rod end is pivotably secured to a second side of the mast and the cylinder end is secured to a second side of the support housing. A hydraulic control circuit is provided for the first and second hydraulic cylinders. The control circuit comprises an overload protection circuit for the first and second cylinders and a means for selectively disabling the overload protection circuit.

In accordance with still another aspect of the present invention, an actuating mechanism is provided which allows a substantially 180° pivoting motion of a frame, and hence a boom arm secured to the frame, around the frame's pivot axis with the frame being pivotably secured to the vehicle.

More particularly in accordance with this embodiment of the invention, the actuating mechanism comprises a mast to which the frame is fixedly secured with the mast being rotatably secured to an associated vehicle. An first hydraulic cylinder having a piston rod end and a cylinder end is provided. One end of the first cylinder is pivotably secured to a first side of the mast and an other end of the cylinder is operatively secured to the vehicle. A second hydraulic cylinder having a piston rod end and a cylinder end is also provided. One end of the second cylinder is pivotably secured to a second side of the mast and an other end of the second cylinder is operatively secured to the vehicle. A control means is operatively associated with the first and second hydraulic cylinders for effecting a linear movement of the piston rods and hence a pivotal movement of the mast and the boom arm secured to the frame about the mast's pivot axis.

One advantage of the present invention is the provision of a new and improved boom arm pivoting mechanism.

Another advantage of the present invention is the provision of an earth working machine which includes a linkage mechanism that allows a substantially 180° pivoting motion of a boom arm supported on the machine in relation to the machine.

Still another advantage of the present invention is the provision of an actuating mechanism which includes a pair of hydraulic cylinders with at least one of the cylinders being provided with an overload protection circuit.

An additional advantage of the present invention is the provision of an actuating mechanism including a pair of hydraulic cylinders as well as an overload protection circuit for at least one of them in which a means is provided for selectively disabling the overload protection circuit.

A further advantage of the present invention is the provision of a two cylinder actuating mechanism having a control means that includes a valve which selectively allows communication between a source of pressurized hydraulic fluid and one or the other of the first and second hydraulic cylinders.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein.

DETAILED DESCRIPTION OF PREFERRED AND ALTERNATE EMBODIMENTS

Figure 1:
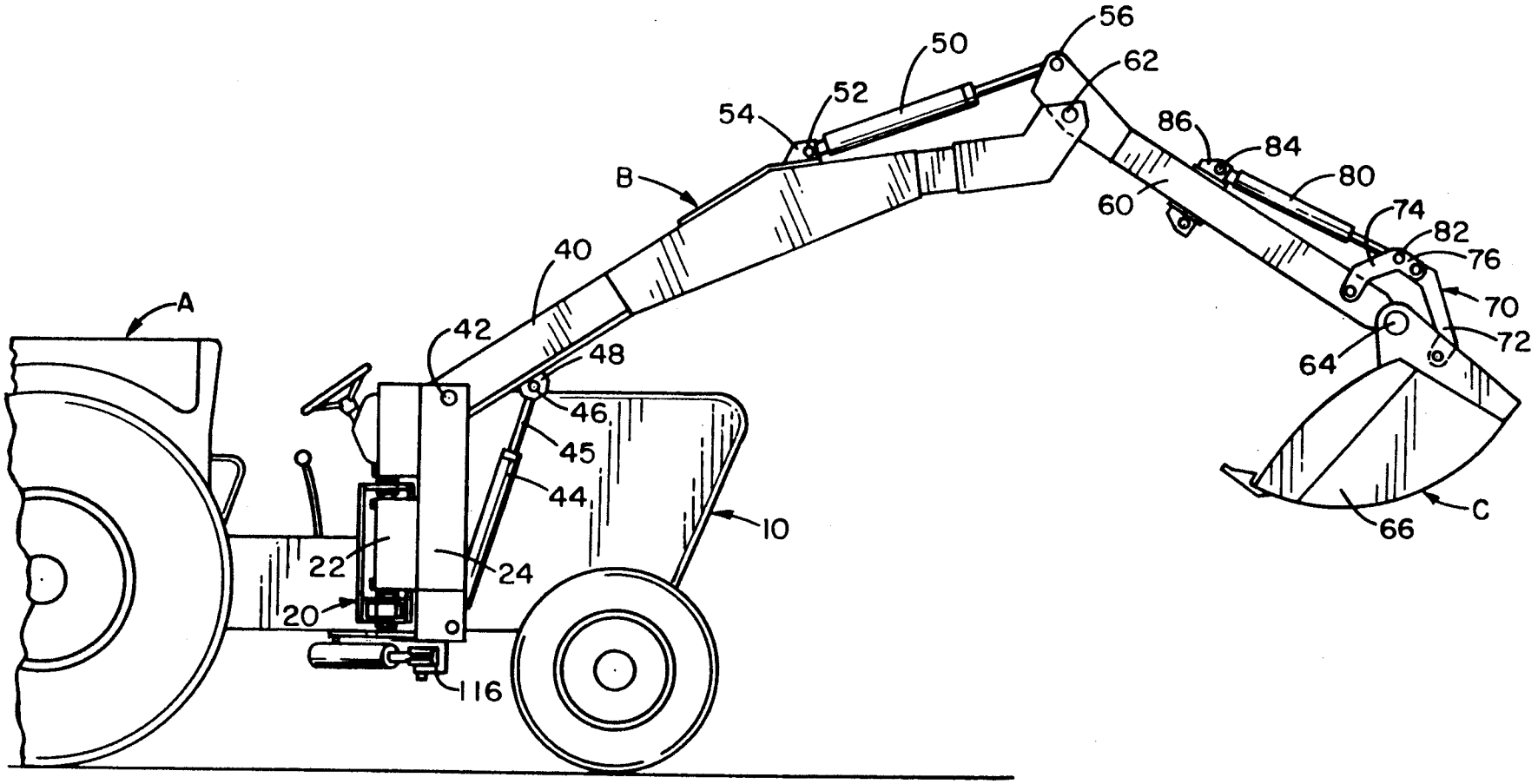
FIG. 1 is a side elevational view of a road maintenance vehicle including a trencher bucket that is secured to a boom assembly attached to the vehicle according to a first preferred embodiment of the present invention.

Referring now to the drawings, wherein the showings are for purposes of illustrating preferred and alternate embodiments of the invention only and not for purposes of limiting same, FIG. 1 shows a vehicle A having a boom assembly B to which is secured an earth working mechanism C according to the present invention. While the invention will be described in connection with a vehicle on which a trencher bucket is mounted, it should be appreciated that the invention could be adapted for use in other environments, such as boom arms holding a mower, other equipment for digging, cutting or moving soil as well as boom arms used in other environments.

More specifically, the vehicle A preferably comprises a tractor 10 having secured thereto a saddle frame 20 that extends across the tractor and retains the boom arm assembly B in place. Secured to the frame 20 along one side thereof is a vertical mast 22 comprising a channel frame 24. The vertical mast 22 is mounted on the tractor 10 by frame 20 and is capable of pivoting about a substantially vertical axis. This permits the boom assembly B to rotate fore and aft in relation to the longitudinal axis of the tractor. Such rotation may be in response to impacting large rocks, posts or other stationary objects, if a breakaway mechanism is present. Rotation is also needed to a storage position and to any desired working orientation.

Included in the arm assembly B is an inner boom arm 40 that is secured at a first end by a pivot pin 42 to the channel 24. Positioned in the channel 24 of the vertical mast is a hoist cylinder 44 that is pivotably secured at a first end in the channel member. A piston rod 45 of the hoist cylinder is secured by a pin 46 to a clevis 48 of the inner arm 40. Operably secured to the inner arm 40 is a crowd and retract cylinder 50. In this regard, a first end of the cylinder 50 is rotatably secured by a pin 52 to a clevis 54 located on the inner arm 40. An end pin 56 rotatably secures a piston rod end of the crowd and retract cylinder 50 to an end of an outer boom arm 60. The outer arm 60 is pivotably secured by a pin 62 to the free end of the inner arm 40 and by a pin 64 to a trencher bucket 66 which comprises the earth working mechanism C in this embodiment.

A linkage assembly 70 is provided between the outer arm 60 and the trencher bucket 66. This assembly includes a trunion link 72, as well as an arm link 74 having an elbow section 76. A cylinder 80 having a piston rod that is rotatably secured by a pin 82 to the elbow section 76 of the arm link 74 is provided. A second end of the cylinder is rotatably secured by a pin 84 to a clevis 86 affixed to the outer arm 60.

Figure 2:
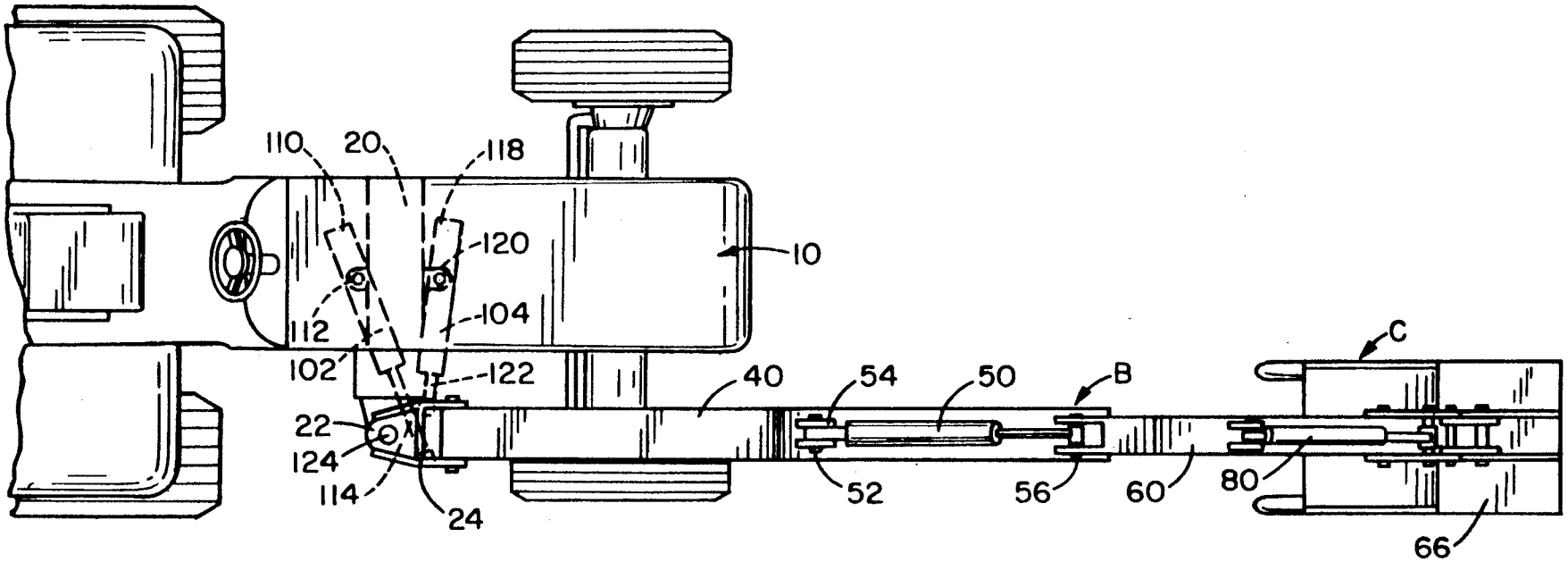
FIG. 2 is an top plan view of the vehicle of FIG. 1.
Figure 2A:
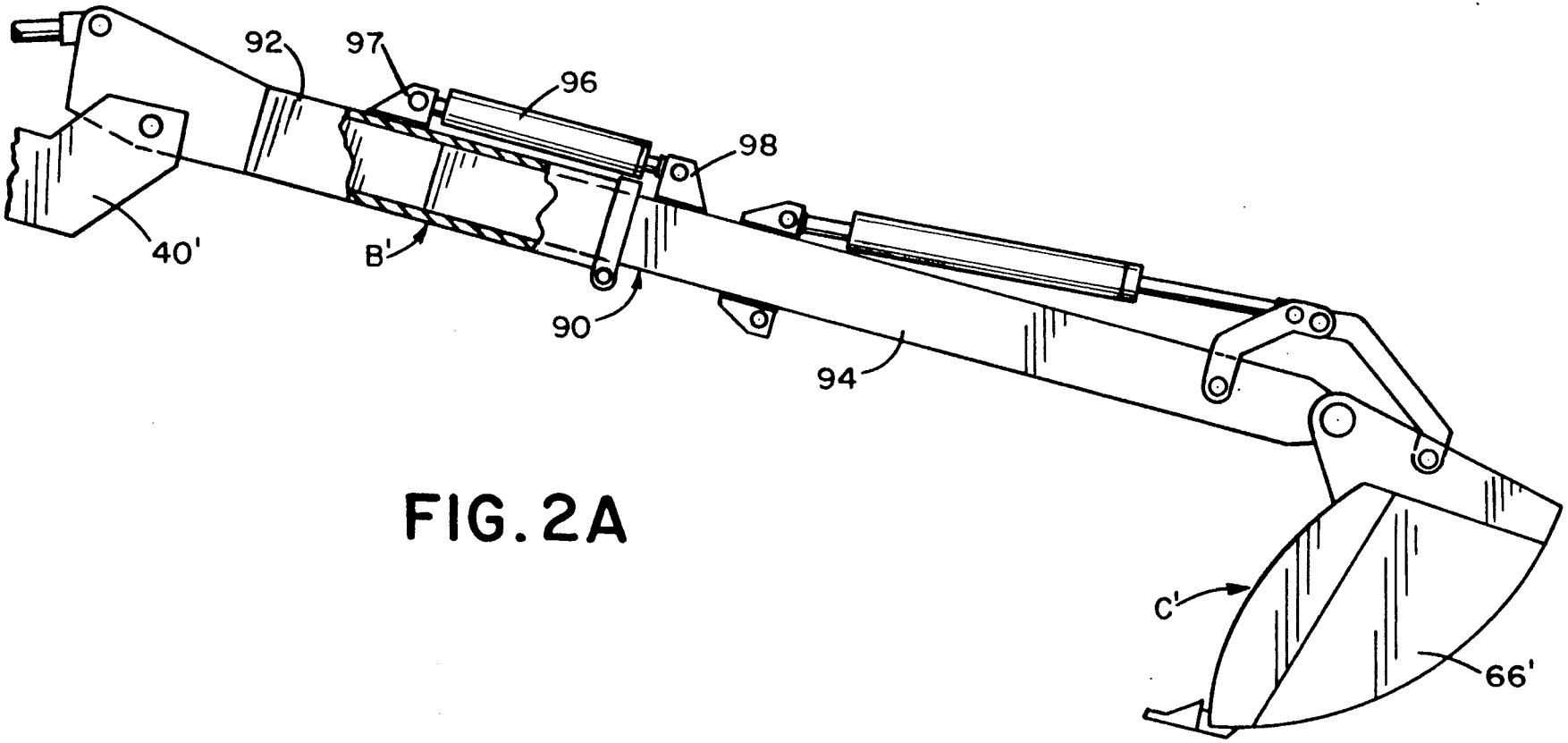
FIG. 2A is an enlarged side elevational view of a portion of a boom assembly according to a first alternate embodiment of the present invention.

With reference now to FIG. 2A, a telescoping boom arm assembly B' is there illustrated. For ease of comprehension and appreciation of this alternative, like components will be identified by like numerals with a primed suffix (') and new components will be identified by new numerals.

In this FIGURE, an outer boom arm 90 is secured to an inner boom arm 40'. The outer boom arm comprises a first section 92 and slidably held therein a second telescoping section 94. A telescoping cylinder 96 is secured by respective first and second devises 97 and 98 to the first and second sections 92 and 94 of the outer arm assembly 90. Provided at a free end of the second section 94 is a suitable trencher bucket 66' comprising the earth working mechanism C. A telescoping boom arm has been found advantageous for certain applications.

As shown in FIG. 2, a pair of hydraulic swing cylinders 102 and 104 are utilized in order to rotate the boom assembly B of the preferred embodiment. The first swing cylinder 102 has a cylinder end 110 adjacent which the cylinder is pivotably secured to a flange 112 that extends at substantially a right angle to the harness 20. If desired, the cylinder 102 can be pivotably secured to the flange 112 approximately 3 to 4 inches from the cylinder end 110. The cylinder 102 also has a piston rod end 114 which is pivotably secured, through a suitable clevis 116 (FIG. 1) to a first side of the channel frame 24. Similarly, the second cylinder 104 includes a cylinder end 118 adjacent which the cylinder is secured pivotably to a second flange 120 that extends at substantially a right angle to a second side of the saddle frame 20. The second cylinder also includes a piston rod end 122 which is suitably secured to a clevis (not visible) mounted to another side of the frame 24. In this way, a linear motion of the two cylinders 102 and 104 will translate into a pivotal motion of the boom assembly B around a vertical pivot axis 124 of the vertical mast 22 around the saddle frame 20. Due to the location of the pivots for the cylinders 102 and 104 and the flanges 112 and 120, the boom arm B is able to be pivoted somewhat more than 180° around axis 124.

Figure 5:
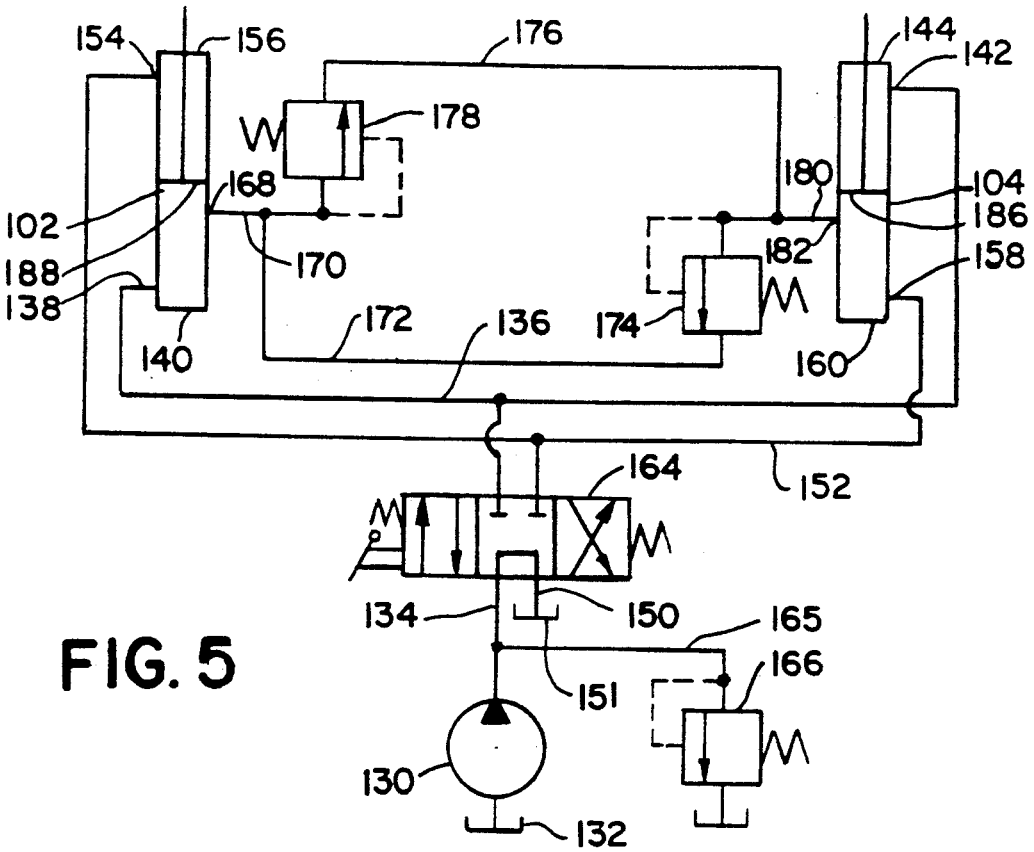
FIG. 5 is a first preferred embodiment of a control means and an overload protection circuit for a pair of hydraulic cylinders that are disclosed in FIG. 2.

One suitable hydraulic control circuit used to actuate the pair of cylinders 102 and 104 is illustrated in FIG. 5. In this circuit, a pump 130 pressurizes a hydraulic fluid withdrawn from a sump 132 and sends it to a first hydraulic line 134. That line communicates with a second hydraulic line 136 having a first end 138 adjacent a first cylinder free end and a second end 142 adjacent a second cylinder piston rod end 144. In other words, the opposite ends of the first and second cylinders 102 and 104 are connected by the line 136.

Figure 6:
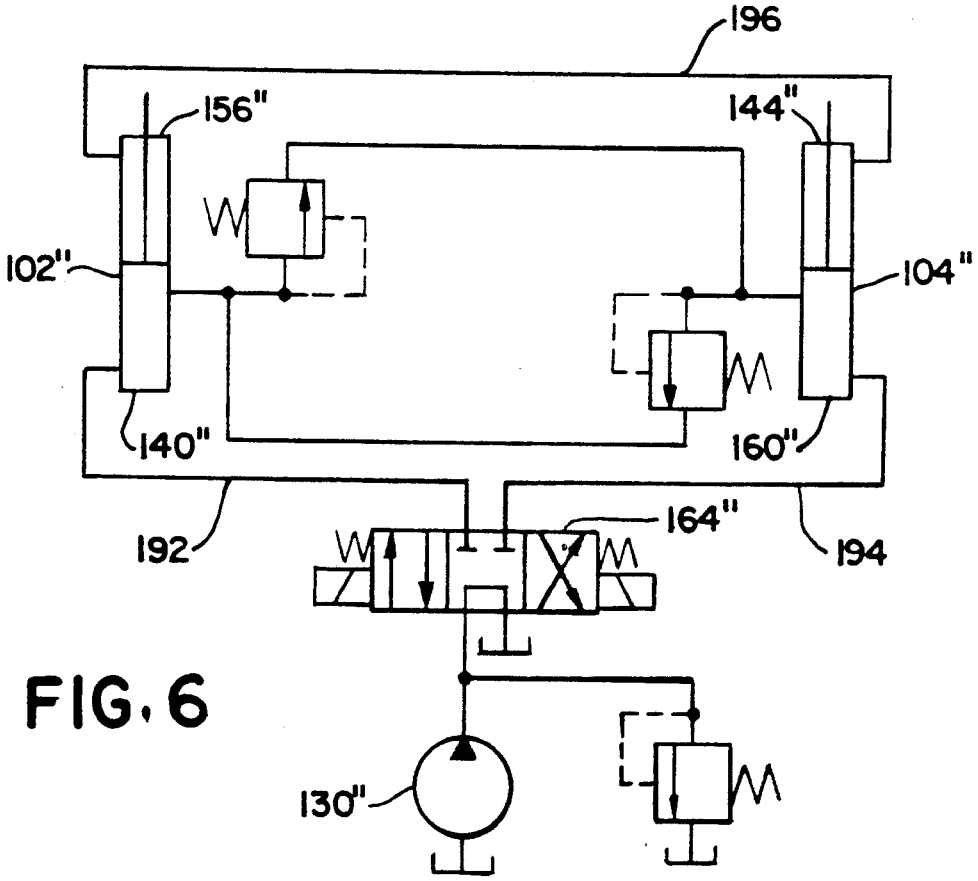
FIG. 6 is a first alternate embodiment of a hydraulic control circuit for the cylinders of FIG. 5.

A third line 150 extends from a sump 151, which may be the same as the sump 132 or may be a separate sump, to a fourth line 152. The fourth line has a first end 154 that communicates with the cylinder 102 adjacent a piston rod end 156 thereof. The fourth line also has a second end 158 which communicates with the second piston 104 adjacent a second cylinder free end 160. In other words, the opposing ends of the first and second cylinders 102 and 104 are connected by the fourth line 152 in the same manner as by the line 136. Regulating the flow of hydraulic fluid to the first line 134 and the third line 150 is a suitable conventional valve 164. In the embodiment illustrated, the valve is a three envelope four way valve having a center neutral or off position and left and right actuated positions as shown. The valve may be spring biased to the center neutral or off position and can be manually moved to either one of the actuated positions. Of course it should be recognized that other suitable valve configurations could also be provided. In addition, the valve can be solenoid actuated if desired, as shown in FIG. 6, instead of being manually actuated. Communicating with the first line 134 through a relief line 165 is a relief valve 166 as is well known in the art.

Extending from a port 168 near the midpoint along the length of the first cylinder 102 is a fifth line 170. Communicating with the fifth line 170 is a sixth line 172 in which is located a second relief valve 174. Also communicating with the fifth line 170 is a seventh line 176 in which is located a third relief valve 178. Communicating with the distal ends of the sixth and seventh lines 172 and 176 is an eighth line 180 that extends to a port 182 near the midpoint along the length of the second cylinder 104.

The fifth through eighth lines 170, 172, 176 and 180 as well as the second and third relief valves 174 and 178 serve as a breakaway system for the pair of hydraulic cylinders 102 and 104. The first relief valve 174 permits pressurized hydraulic fluid to flow out of the second cylinder 104 when a pressure limit on the valve 174 is exceeded as a piston 186 in the second cylinder 104 moves downwardly and pressurizes the hydraulic fluid below it. That fluid will flow into line 182 and trip the relief valve 174. The hydraulic fluid will then flow through line 172, through line 170 and into the first cylinder 102 below its piston 188. The two relief valves 174 and 178 and the associated fluid lines allow the arm assembly B and the earth working device C to swing away in response to a preselected breakaway pressure or force. In other words, the system allows the arm assembly B to swing forward or rearward in response to a preselected breakaway pressure or force. The force to cause the arm assembly, and the ditcher bucket 66 or similar earth working device secured thereto, to break away forward direction and a rearward direction may be the same or different. Such a breakaway assembly will prevent damage to either the boom arm assembly B or the earth working device C when the earth working device, such as the ditcher bucket 66, impacts relatively immoveable objects such as stamps, fenceposts, large rocks or the like.

If desired, the boom operating pressure may be on the order of 1200 psi and the relief valves 174 and 178 may be set to, e.g. 1350 psi for breakaway pressure. Operating pressure for the hydraulic cylinders 102 and 104 can be generally in the range of 1200 to 1800 psi. The breakaway pressure is set just a little bit above the operating pressure of the cylinders. However, the breakaway pressure is set below the maximum hydraulic operating pressure of the main circuit which may be on the order of 2,000 to 2,250 psi. This allows for some tolerance in the circuit.

In the embodiment illustrated in FIG. 5, however, the ports 168 and 182 for the respective cylinders 102 and 104 are located somewhere near the respective canter of each of the cylinders. This is advantageous in providing a breakaway feature for the system only when the boom mechanism B is located approximately normal to the longitudinal axis of the vehicle A. In other words, the breakaway feature would exist only for, e.g. 7–10 degrees on either side of an orientation of the boom arm is assembly substantially perpendicular to a longitudinal axis of the vehicle A. No breakaway feature would be provided from that point forward and rearward for the swinging movement of the boom arm. Such a limited breakaway feature is advantageous in a situation where the vehicle is located on an inclined surface, e.g. on a hillside berm adjacent a road.

A problem would exist if the vehicle is positioned on an inclined surface and an unlimited breakaway feature is provided. When using the ditcher bucket 66, if the operator were swinging a bucket full of dirt and the breakaway feature inadvertently engages due to centrifugal force, the boom arm assembly would then start swinging uncontrollably and might tip over the vehicle. Accordingly, to prevent such problems the breakaway feature is operative only during a limited degree of movement of the boom arm. The breakaway feature would be disengaged just as soon as the respective piston 188 and 186 of the respective cylinder 102 and 104 passes over its respective port 168 and 182. After that point, the breakaway feature would be disengaged and the boom would not be allowed to swing away even if a hydraulic shock were experienced by the circuit.

With reference now to FIGS. 6–9 several alternate embodiments of the hydraulic circuit are there illustrated. For ease of comprehension and appreciation of these alternatives, like components will be identified by like numerals with a double primed suffix (") and new components will be identified by new numerals.

in FIG. 6, the circuit includes a pump 130" which supplies hydraulic fluid through a valve 164" to a first line 192 communicating with a first cylinder free end 140". The pump also supplies hydraulic fluid as directed by the valve 164" to a second line 194 which supplies hydraulic fluid to a second cylinder free end 160". In this embodiment, a third hydraulic fluid line 196 interconnects the first cylinder piston rod end 156" and the second cylinder piston rod end 144". In other words, in the embodiment of FIG. 6, as opposed to FIG. 5, the two cylinder piston rod ends are connected to each other. In contrast, in the embodiment of FIG. 5 the first cylinder free end 140 is connected to the second cylinder piston rod end 144 whereas the first cylinder piston rod end 156 is connected to the second cylinder free end 160. The breakaway circuit illustrated in FIG. 6 is identical to that illustrated in FIG. 5.

Figure 7:
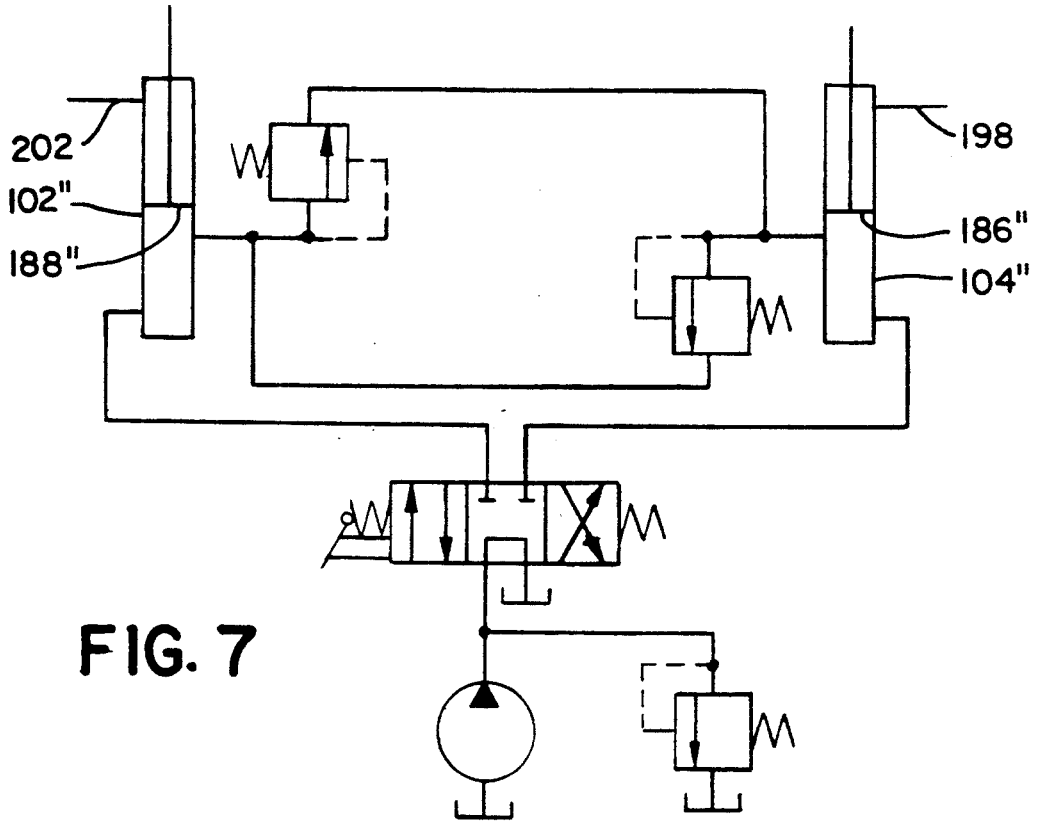
FIG. 7 is a second alternate embodiment of a hydraulic control circuit and an overload protection circuit according to the present invention.
Figure 8:
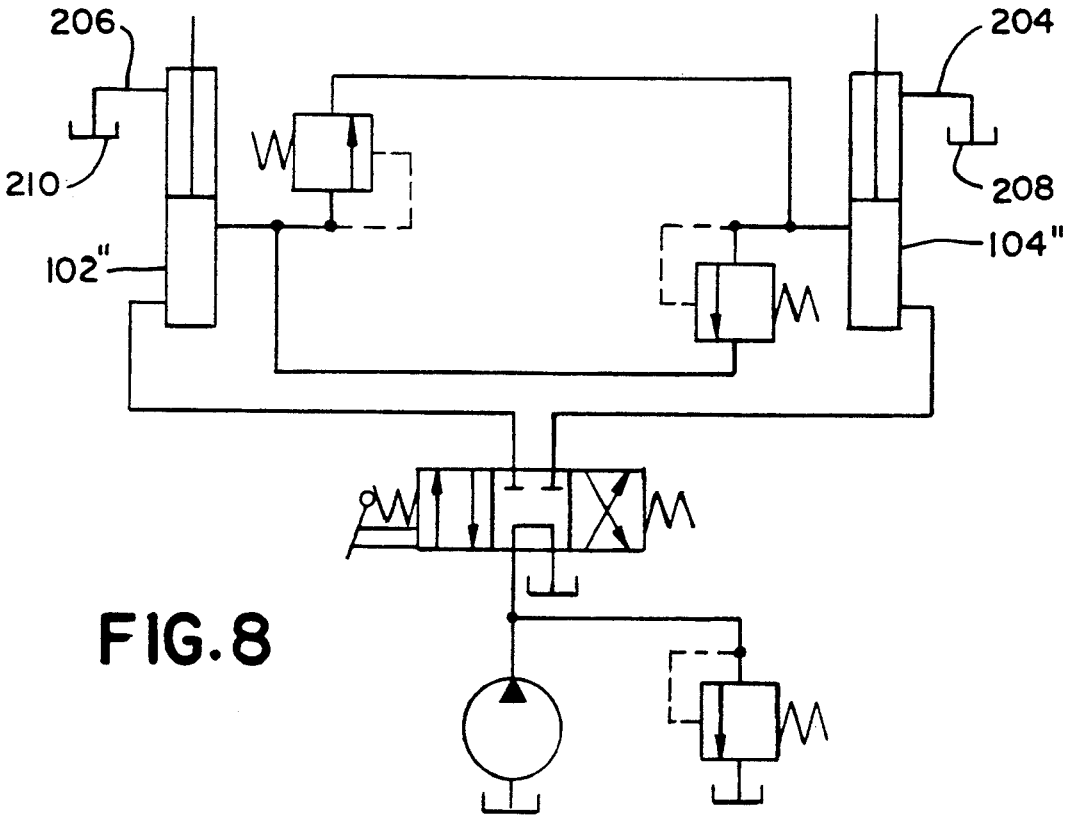
FIG. 8 is a third alternate embodiment of a hydraulic control circuit and an overload protection circuit according to the present invention; and, FIGS. 9–21 are still additional embodiments of hydraulic control circuits and overload protection circuits which can be utilized with either of the road maintenance vehicles disclosed in FIGS. 1 and 3.

FIGS. 7 and 8 show alternate embodiments in that in FIG. 7 the line 196 is replaced by separate lines 198 and 202 which communicate the cylinder piston rod ends to the atmosphere. Obviously, in the embodiment of FIG. 7, the cylinders above the pistons 186" and 188" are filled with air rather than hydraulic fluid so as to avoid any environmental pollution. Hydraulic fluid leakage around the piston is prevented by the conventional use of seals or packing rings. In FIG. 8, lines 204 and 206 are illustrated as extending from the respective piston rod ends of the cylinders 102" and 104". In this embodiment, the lines 204 and 206 lead to conventional sumps 208 and 210. Accordingly, in the embodiment of FIG. 8, hydraulic fluid is provided above the pistons reciprocating in the cylinders.

Figure 9:
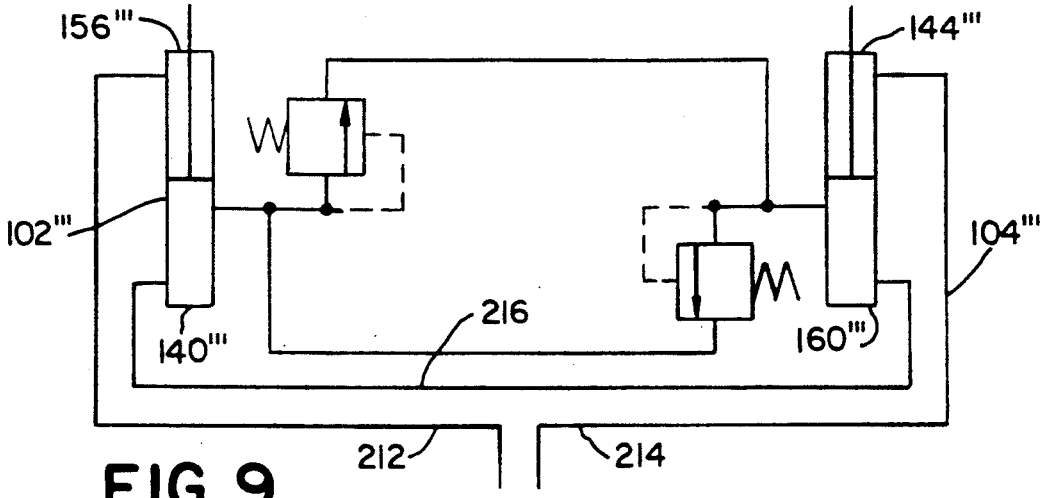

FIG. 9 discloses yet another embodiment of the hydraulic circuit. For ease of comprehension and appreciation of this alternative, like components will be identified by like numerals with a triple primed suffix (''') and new components will be identified by new numerals.

In this embodiment, a first line 212 communicates with a piston rod end 156''' of a first hydraulic cylinder 102''' and a second line 214 communicates with a piston rod end 144''' of a second hydraulic cylinder 104'''. In this embodiment, a third line 216 communicates the free ends 140''' of end 160''' of the first and second cylinders. Thus, in this embodiment the two cylinder piston rod ends are not fluidly inter-connected at all but the two cylinder ends are interconnected. Again, breakaway circuit is identical to that disclosed in FIG. 5.

Figure 3:
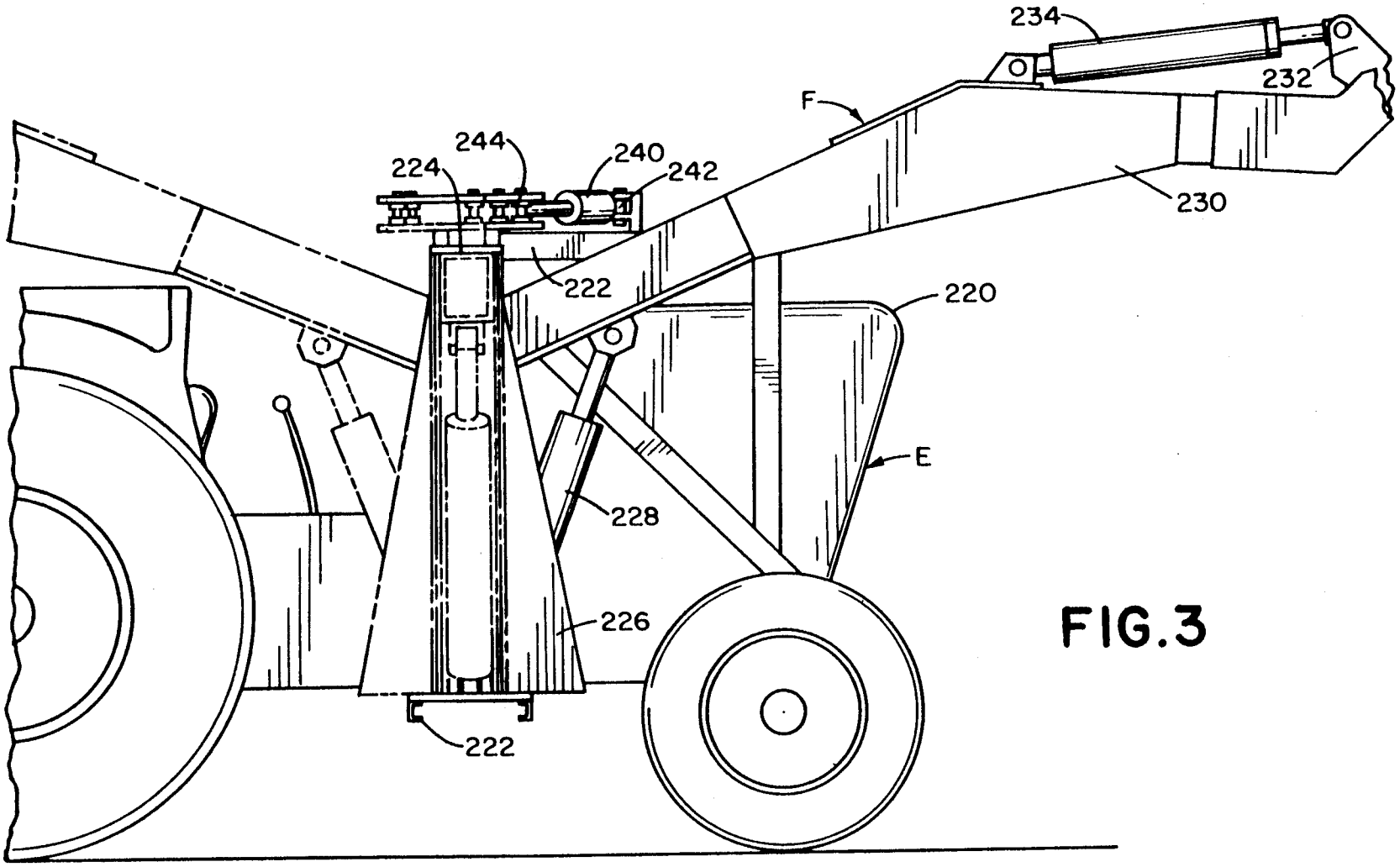
FIG. 3 is a side elevational view of a road maintenance vehicle and boom assembly secured thereto according to a second preferred embodiment of the invention.
Figure 4:
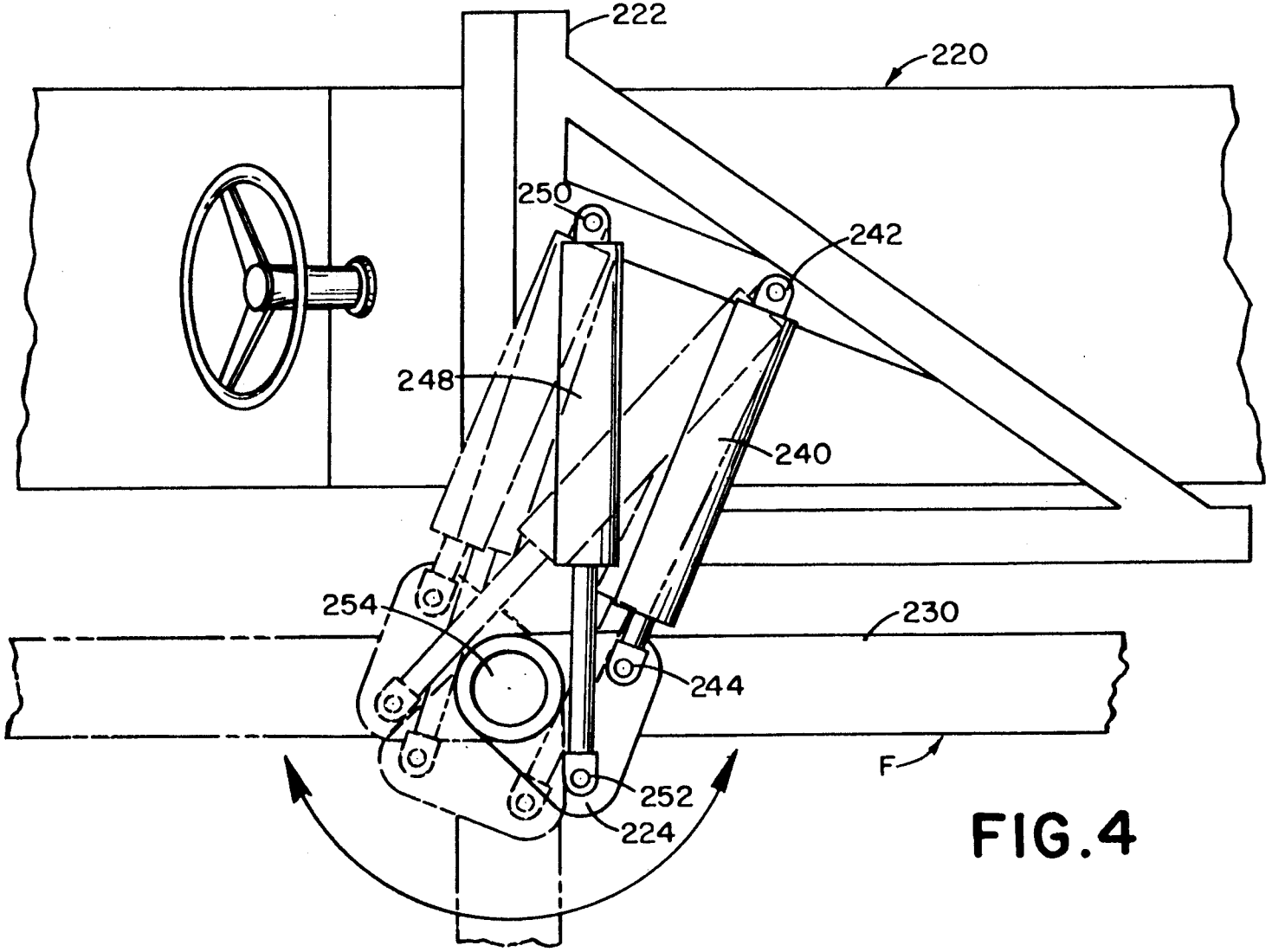
FIG. 4 is an enlarged top plan view of a portion of the vehicle of FIG. 3.

With reference now to FIGS. 3 and 4, a second preferred embodiment of a boom control assembly is there illustrated. The construction includes a vehicle E on which is pivotably mounted a boom assembly P. More particularly, the vehicle E can comprise a tractor 220 which has secured thereon a saddle frame 222 including a vertical mast 224 and a channel frame 226. Secured at one end to the channel frame is a hoist cylinder 228. At its other end, the hoist cylinder is secured to an inner boom arm 230 of the boom assembly F. Provided between the inner boom arm 230 and an outer boom arm 232 is a crowd and retract cylinder 234. Secured to the free end of the outer boom arm is a suitable earth working tool (not illustrated) such as the scraper bucket disclosed in FIGS. 1 and 2 or a similar suitable tool.

With reference now also to FIG. 4, provided for rotating the boom assembly F is a first cylinder 240 having a cylinder or first end 242 that is secured to the saddle frame 222 and a piston rod or second end 244 which is secured to one side of the vertical mast 224. Spaced from the first cylinder 240 is a second cylinder 248 which also has a cylinder first end 250 secured to the saddle frame 222 and a piston rod or second end 252 which is pivotably secured to another side of the vertical mast 224. As can be seen, the vertical mast rotates about a vertical axis 254 in relation to the saddle frame 222. The cooperation of the first and second cylinders 240 and 248 enable the boom assembly F to pivot approximately 180° in relation to the vertical axis. Such pivoting is accomplished as the piston rods retract into and extend from the two cylinders 240 and 248 thereby rotating the vertical mast 224 around its axis.

Figure 10:
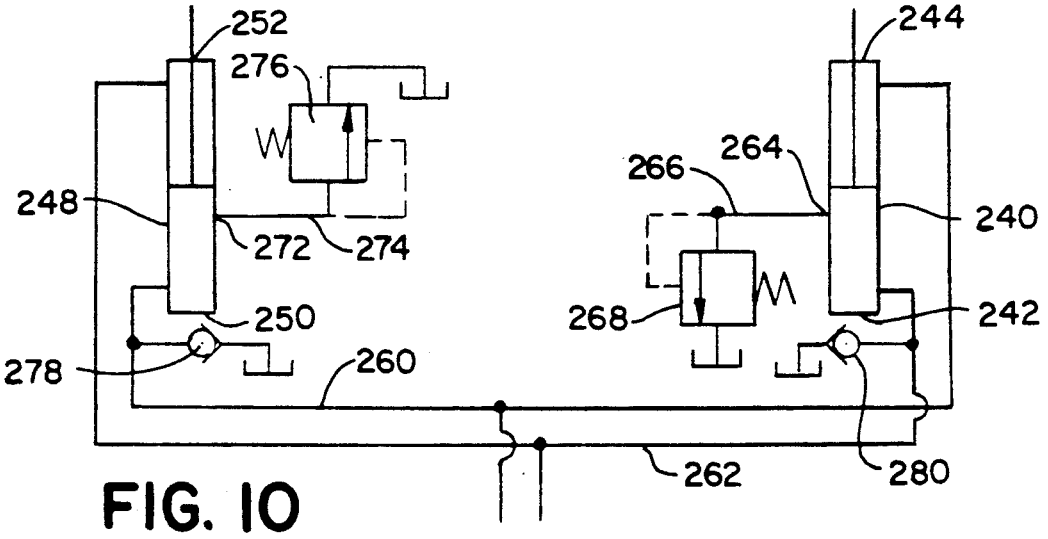

While several suitable hydraulic circuits for actuating a pivoting movement of the boon assembly F were illustrated in FIGS. 5–9, many alterantive circuits exist as well. One suitable hydraulic circuit for actuating the two cylinders 240 and 248 is illustrated in FIG. 10. The circuit includes a first line 260 which communicates the second cylinder first end 250 with the first cylinder second end 244. A second line 262 communicates the first cylinder first end 242 with the second cylinder second end 252.

Connected to a port 264 near the midpoint of the first cylinder 240 is a third line 266. Located in this line is a relief valve 268 which selectively allows hydraulic fluid to flow into a sump. Connected to a port 272 near the midpoint of the second cylinder 248 is a fourth line 274 and a relief valve 276 is located in that line. The relief valve selectively allows pressurized hydraulic fluid to flow into a sump. Positioned in the first line 260 is a first check valve 278 and located in the second line 262 is a second check valve 280. In contrast to the breakaway circuit embodiments disclosed in FIGS. 5–9, in FIG. 10 the two relief valves 268 and 276 are not fluidly interconnected. Rather, each valve separately vents to a sump. It is for that reason that check valves 278 and 280 are necessary in order to replenish the respective hydraulic cylinder with fluid when the respective piston in the cylinder 240 and 248 moves upwardly, i.e. to the piston rod end or second end 244 and 252 of the respective cylinder.

Figure 11:
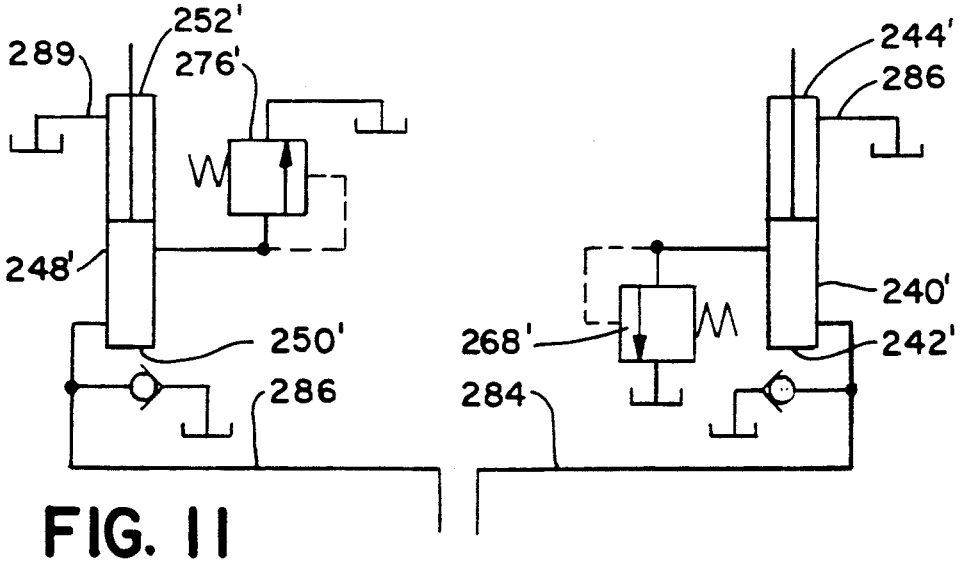

With reference now to FIG. 11, another embodiment of a hydraulic circuit is there illustrated. For ease of illustration and appreciation of this alternative, like components are identified by like numerals with a primed suffix (') and new components are identified by new numerals.

In this embodiment, a first hydraulic cylinder 240' communicates at its first and 242' with a first fluid line 284. The second end 244' of the first hydraulic cylinder communicates with sump through a suitable line 286. A second hydraulic fluid cylinder 248' communicates at its first end 250 with a second line 288, while a second end 252' of the second hydraulic cylinder 248' communicates with sump through a suitable line 289. The breakaway system is identical to that illustrated in FIG. 10 and involves a pair of relief valves 268' and 276' which are not tied to each other through common fluid lines.

Figure 12:
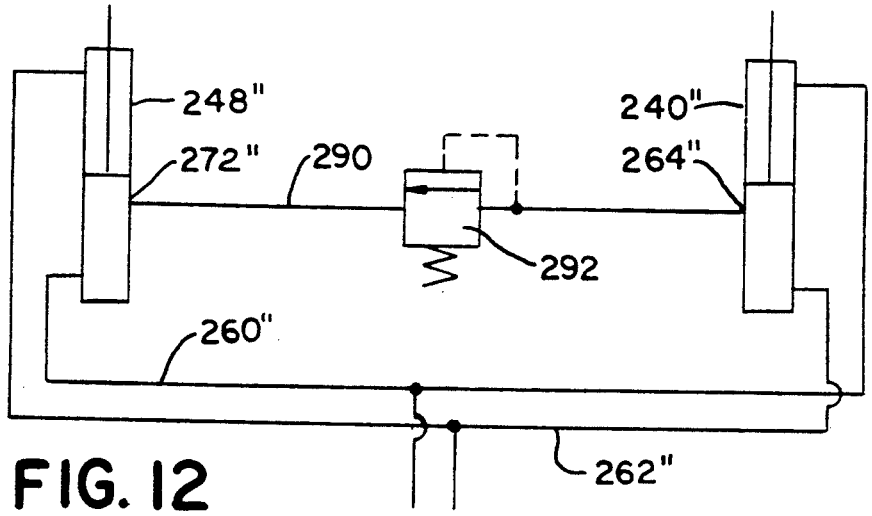

With reference now to FIG. 12, a second alternate embodiment of a hydraulic fluid control circuit is there illustrated. This embodiment discloses a uni-directional breakaway circuit, unlike the foregoing embodiments which dealt with a situation where a breakaway in both directions was provided. For ease of illustration and comprehension of this alternative, like components are identified by like numerals with a double primed (") suffix and new components are identified by new numerals.

This circuit involves a pair of hydraulic cylinders 240'' and 248'' that are connected through a pair of hydraulic fluid lines 260'' and 262'' just as in FIG. 10. However, a different hydraulic breakaway circuit is here illustrated. This circuit involves a third hydraulic fluid line 290 which extends between a pair of ports 264'' and 272'' located on two hydraulic cylinders 240'' and 248''. Located in the line 290 is a suitable relief valve 292 which selectively allows hydraulic fluid to flow from the first cylinder 240'' to the second cylinder 248''. However, a reverse flow is not permitted. Thus this embodiment discloses a uni-directional breakaway circuit which is disabled when the piston in cylinder 240'' moves below the port 264''.

Figure 13:
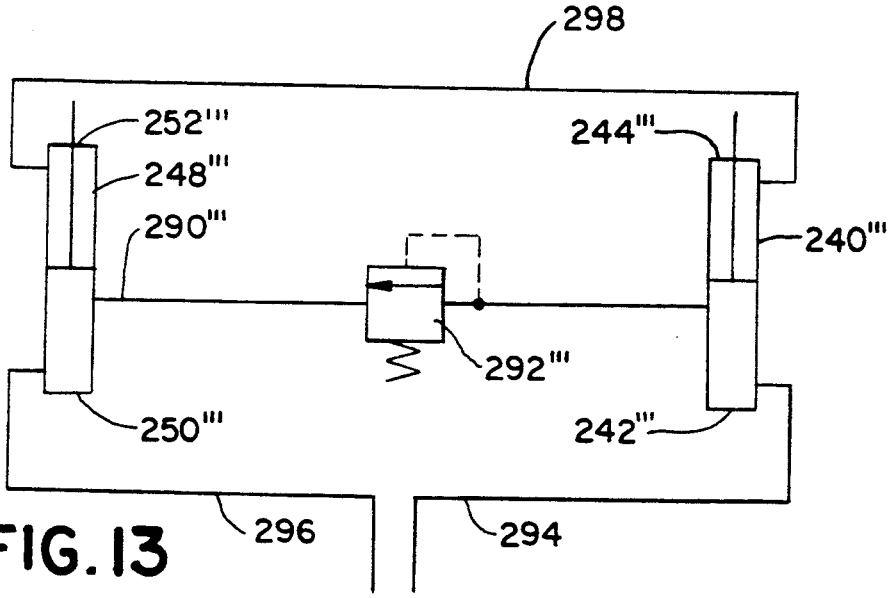

With reference now to FIG. 13, yet another alternate embodiment of the hydraulic control circuit is there illustrated. For ease of illustration and appreciation of this alternative, like components will be identified by like numerals with a triple primed suffix (''') and new components will be identified by new numerals.

In this FIGURE, a first hydraulic fluid line 294 attends to a first end 242''' of a first hydraulic cylinder 240''' and a second hydraulic line 296 extends to a first end 250''' of a second hydraulic cylinder 248'''. The second ends 244''' and 252''' of the first and second hydraulic cylinders are tied together by a third line 298. Extending between the two cylinders is a suitable hydraulic fluid line 290''' having therein a relief valve 292''' along the lines of FIG. 12.

Figure 14:
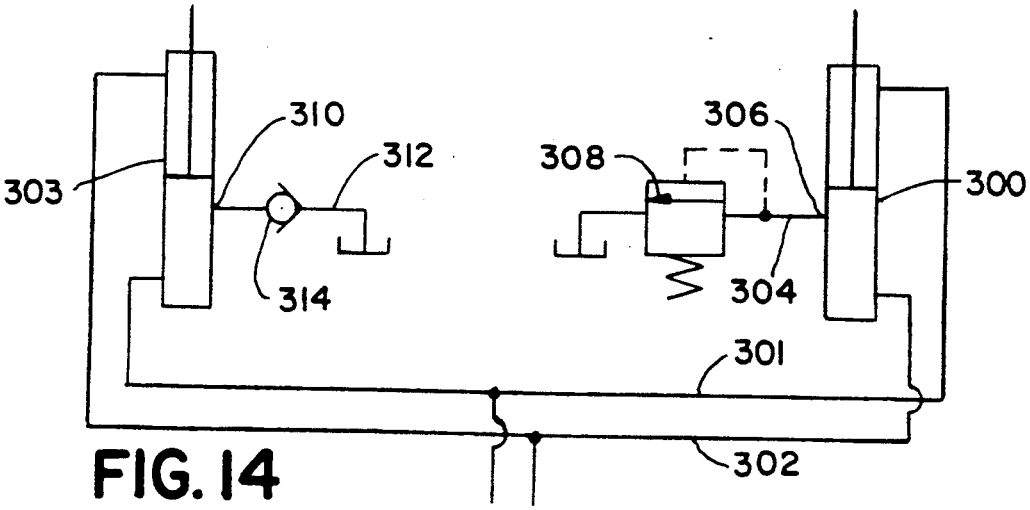

If it is desired to allow a breakaway only in a single direction, a hydraulic circuit such as is illustrated in FIG. 14, can be utilized. In this hydraulic circuit, a first cylinder 300 is connected by suitable fluid lines 301 and 302 to a second cylinder 303 such that a piston rod end of one cylinder is connected with a cylinder end of the other cylinder. To provide a breakaway feature, a fluid line 304 communicates with a port 306 located on the first cylinder 300. A suitable relief valve 308 is provided in the line 304 in order to selectively allow hydraulic fluid to flow therethrough. Connected to a port 310 in the second cylinder 302 is another fluid line 312. A check valve 314 is provided in this fluid line to selectively allow hydraulic fluid to flow from a sump into the cylinder 302 when more fluid is required in the cylinder. As is evident, a selective breakaway is provided for the first cylinder 300 but no such breakaway is provided for the second cylinder 303.

Figure 15:
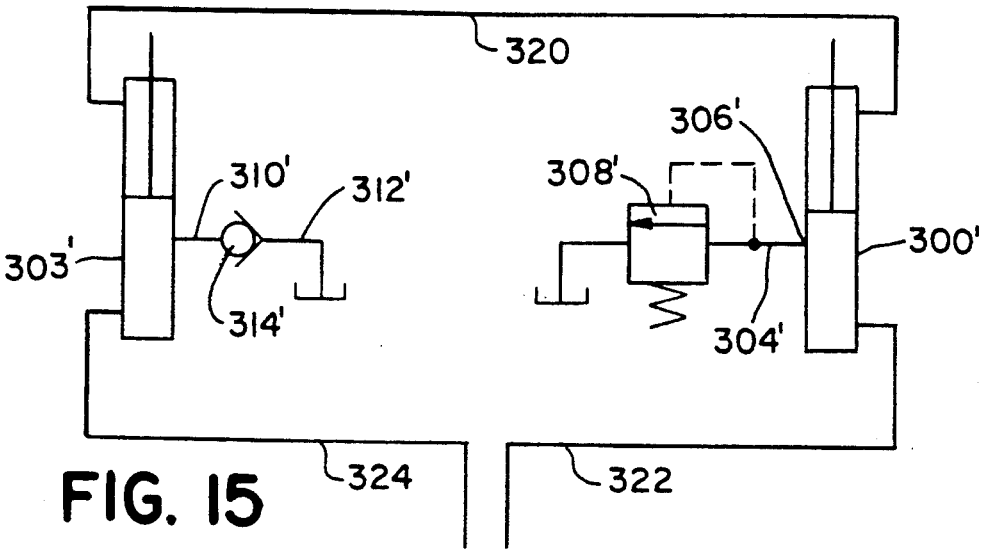

Another hydraulic circuit to accomplish the same purpose is illustrated in FIG. 15. For ease of illustration and comprehension of this alternative, like components will be identified by like numerals with a primed suffix (') and new components will be identified by new numerals.

In FIG. 15, a first fluid line 320 connects the piston rod ends of a first and second cylinder 300' and 303' and separate fluid lines 322 and 324 connect the cylinder ends of the cylinders 300' and 303' with a suitable valve (not illustrated) along the lines of the valves illustrated in FIGS. 5–8. A one way breakaway system is provided as well. Namely, a relief valve 308' is located in a fluid line 304' which extends from a port 306' of the first cylinder 300'. No such relief valve is provided for the second cylinder 303'. Rather, a check valve 314' is provided in a fluid line 312' which extends from approximately a port 310' of the second cylinder 303'. In other words, this FIGURE includes the same fluid lines as FIG. 13 but the breakaway circuit of FIG. 14.

All of the foregoing breakaway circuits included fluid lines which communicated with ports located on the hydraulic cylinders concerned so as to selectively deactivate the breakaway circuits when the pistons in the cylinders would move past the ports thereby preventing the flow of hydraulic fluid to the breakaway circuit. The remaining FIGS. 16–21 illustrate other hydraulic circuits in which the breakaway circuit is not selectively deactivated but is constantly operative.

Figure 16:
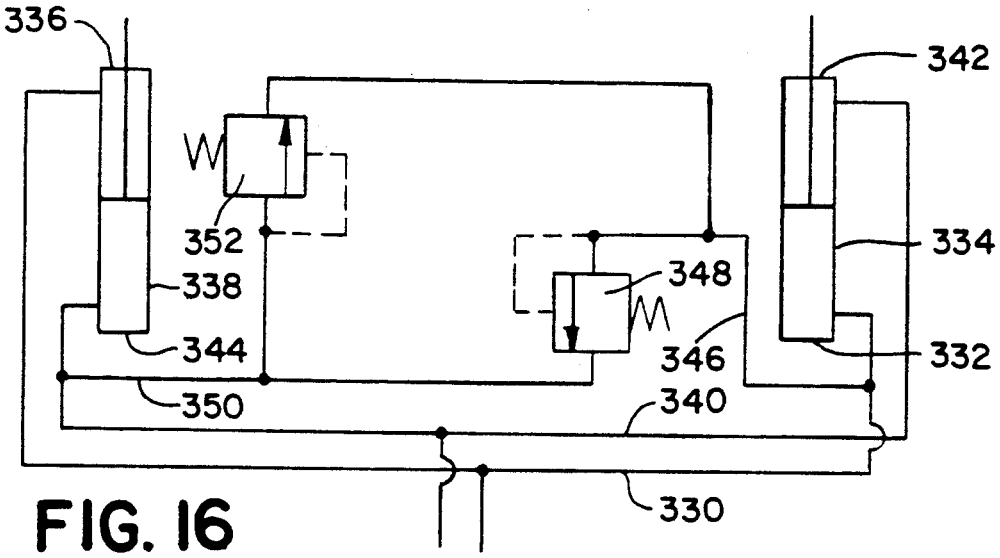

FIG. 16 illustrates a hydraulic circuit in which a first fluid line 330 communicates a cylinder or first end 332 of a first cylinder 334 with a piston rod or second end 336 of a second cylinder 338. Also disclosed is a second hydraulic fluid line 340 which communicates a piston rod or second end 342 of the first cylinder 334 with a cylinder or first end 344 of the second cylinder 338. Communicating the first and second fluid lines 330 and 340 is a breakaway circuit. This circuit includes a third fluid line 346 which communicates with the first fluid line 330 and leads to a first relief valve 348. The relief valve in turn leads to a fourth fluid line 350 which communicates with the second fluid line 340. Located in the fourth fluid line 350 is a second relief valve 352 which selectively allows pressurized fluid to flow back to the third fluid line 346. The two relief valves 348 and 352 allow a breakaway of the cylinders 334 and 338 when a hydraulic fluid shock is experienced by the cylinders as explained hereinabove. However, in contrast to the fluid circuits illustrated in FIGS. 5–15, this breakaway system is constantly operative rather than being disconnected once the piston in the cylinder moves past the cylinder ports illustrated on the various cylinders in FIGS. 5–15. The embodiment of FIG. 16 is along the same lines as the embodiment of FIG. 5 except that the breakaway circuit is tied into the hydraulic lines communicating with the ends of the hydraulic cylinders rather than being tied directly to the cylinders themselves.

Figure 17:
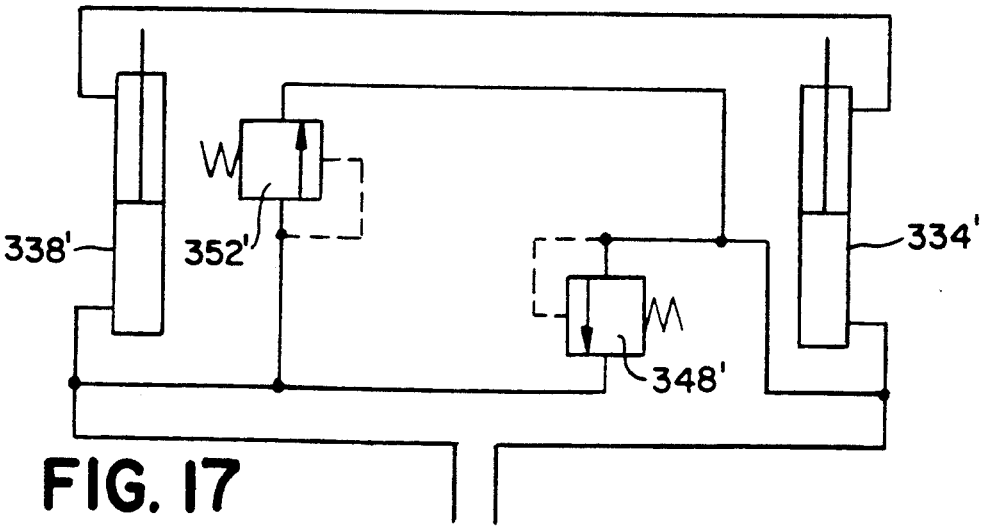

FIG. 17 illustrates two relief valves 348' and 352' and has the same hydraulic fluid lines as FIG. 6 except that the breakaway circuit is tied to the fluid lines rather than the cylinders themselves. Bi-directional breakaway circuits are illustrated in FIGS. 16 and 17.

Figure 18:
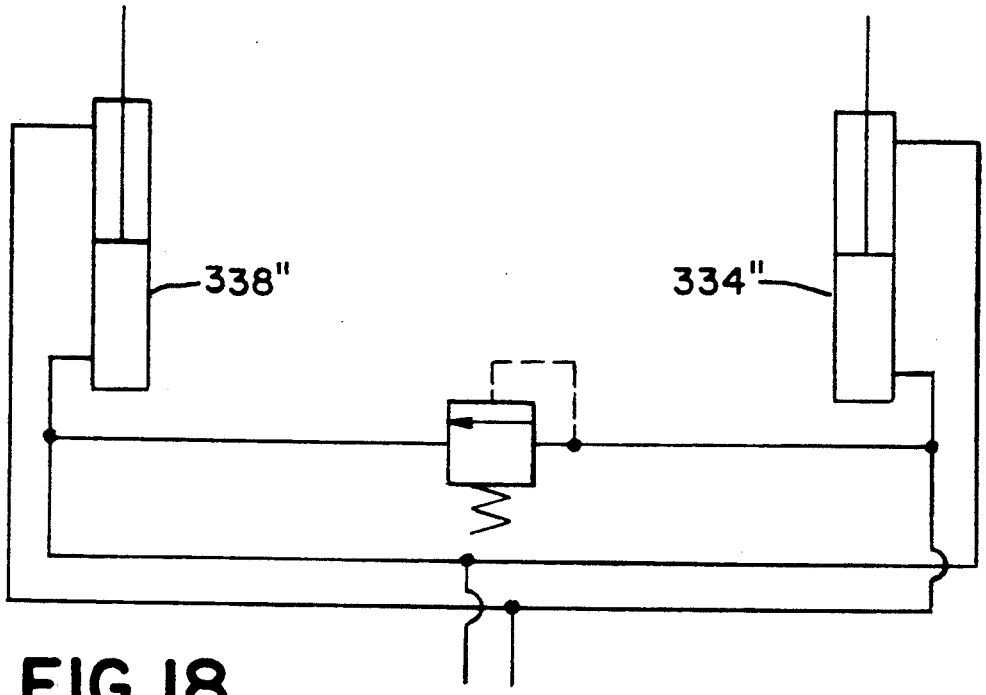
Figure 19:
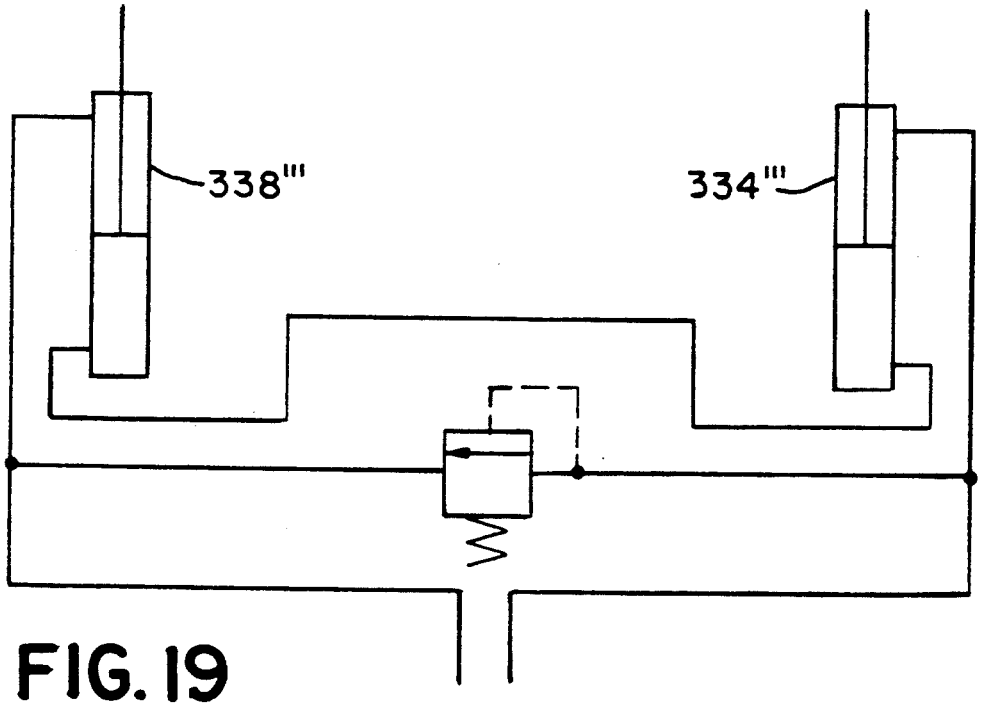
Figure 20:
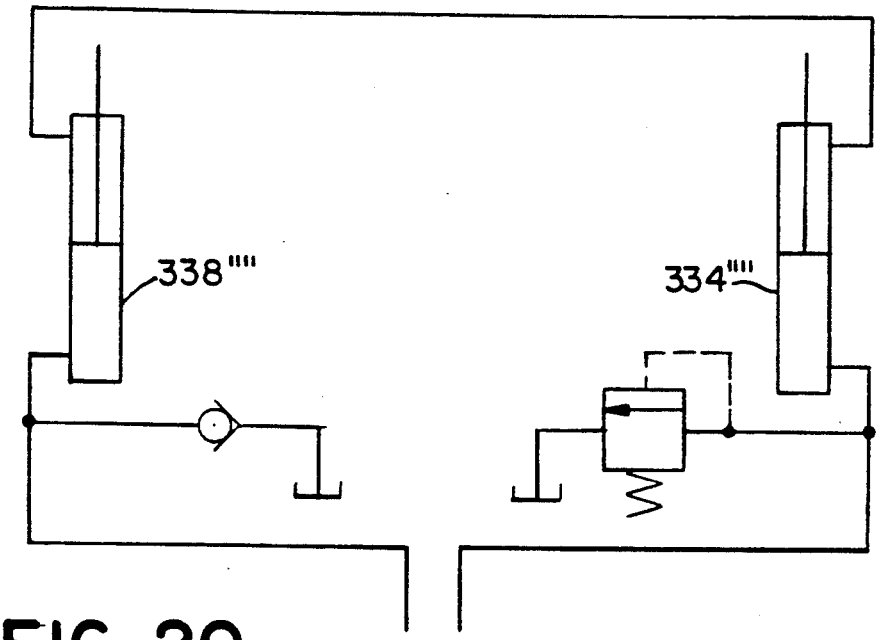
Figure 21:
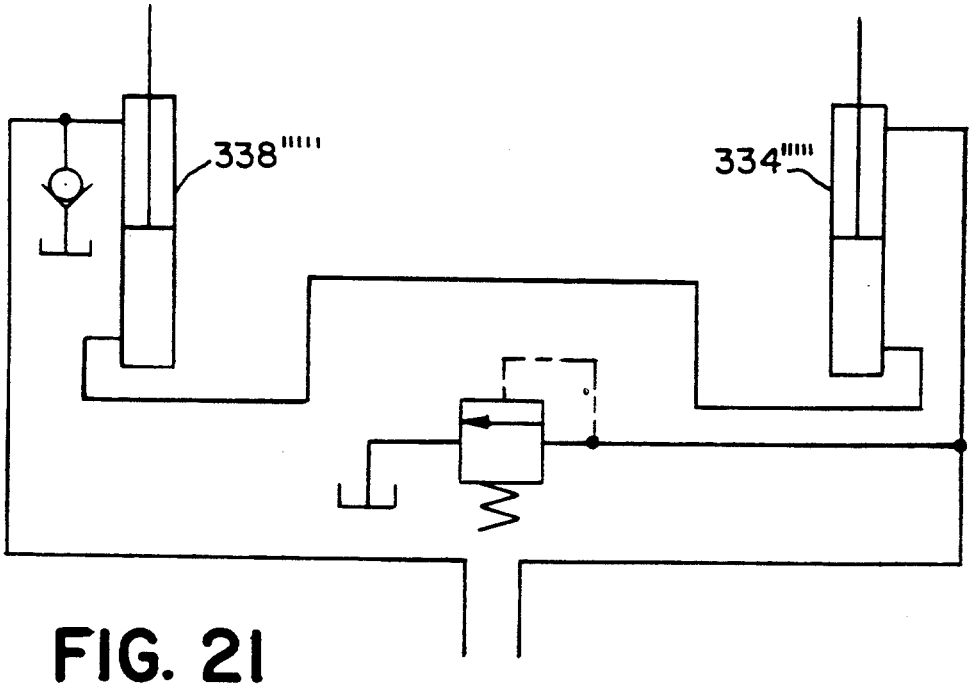

FIG. 18 is similar to FIG. 12 in that two cylinders 334'' and 338'' are shown together with one relief valve. But again the uni-directional breakaway circuit is tied to the fluid lines. FIG. 19 is similar to FIG. 18 but with a different hydraulic fluid line arrangement. Finally, FIGS. 20 and 21 are similar to the breakaway circuit embodiments disclosed in FIGS. 14 and 15 except that the breakaway circuits are tied into the fluid lines rather than directly into the cylinders themselves.

The invention has been described with reference to preferred and alternate embodiments. Obviously, modifications and alterations will occur to others upon the reading and understanding of the preceding specification. It is intended that the invention be construed as including all such alterations and modifications insofar as they come within the scope of the appended claims or the equivalents thereof.

Having thus described the preferred and alternate embodiments, the invention is claimed as follows:

1. A linkage mechanism which allows a substantially 180° pivoting motion of a boom arm around a pivot axis, comprising:

a mast which is pivotably mounted on a pivot axis to an associated support frame, the boom arm being secured at a first end to said mast and supporting on a second end an associated tool;

a first hydraulic cylinder including a piston and a piston rod and having a piston rod end and a cylinder end, one of said first hydraulic cylinder ends being pivotably secured to a first side of said mast and the other end of said first hydraulic cylinder being secured to the associated support frame;

an overload protection circuit connected to said first hydraulic cylinder such that said mast, and the boom arm, will pivot around said pivot axis in the event the associated tool meets an obstruction, wherein said mast will pivot away from the obstruction in order to avoid damaging the associated tool;

a control means connected to said first hydraulic cylinder for effecting a linear movement of said piston rod and a pivotal movement of the mast, and hence the boom arm secured thereto, about the mast's pivot axis; and, a means responsive to a movement of said piston for disabling said overload protection circuit, said means for disabling being located between said overload protection circuit and said first hydraulic cylinder and being connected to both.

2. The mechanism of claim 1 wherein said overload protection circuit is uni-directional.

3. The mechanism of claim 1 further comprising a second hydraulic cylinder having a piston rod end and a cylinder end, wherein one end of said second hydraulic cylinder is pivotably secured to a second side of the mast and another end of said second hydraulic cylinder is pivotably secured to the associated support frame.

4. The mechanism of claim 3, wherein said overload protection circuit comprises a first one way pressure relief valve which permits hydraulic fluid to flow from a first chamber of one of said first and second hydraulic cylinders to a first chamber of another of said first and second hydraulic cylinders.

5. The mechanism of claim 4 wherein said overload protection circuit further comprises a second one way pressure relief valve which permits hydraulic fluid to flow from said first chamber of one of said first and second hydraulic cylinders to said first chamber of another of said first and second hydraulic cylinders, wherein said second one way pressure relief valve is connected to permit flow opposite to that permitted by the first one way pressure relief valve.

6. A road maintenance vehicle construction comprising:

a support housing including a means for securing the housing to a vehicle;

a mast which is rotatably secured to said housing;

a frame fixedly secured to said mast;

a boom member attached at one end to said frame and adapted to hold a road maintenance tool at another end;

a first hydraulic cylinder having a piston rod end and a cylinder end, said piston rod end being pivotably secured to a first side of said mast and said cylinder end being secured to a first side of said support housing;

a second hydraulic cylinder having a piston rod end and a cylinder end, said second hydraulic cylinder piston rod end being pivotably secured to a second side of said mast, and said cylinder end being secured to a second side of said support housing;

a hydraulic control circuit in fluid communication with and controlling an operation of said first and second hydraulic cylinders;

an overload protection circuit in fluid communication with at least one of said first and second cylinders; and, a means for selectively disabling said overload protection circuit, said means for selectively disabling being in fluid communication with said overload protection circuit, wherein said means for selectively disabling comprises a piston of said at least one of said first and second cylinders, a movement of said piston past a preselected point disabling said overload protection circuit.

7. The vehicle of claim 6 wherein said boom member is pivotably secured to said frame and wherein said boom member's pivot axis is horizontally oriented.

8. The vehicle of claim 7 wherein said boom member comprises a telescoping assembly.

9. The vehicle of claim 6 wherein said overload protection circuit is uni-directional.

10. The vehicle of claim 6 wherein said hydraulic control circuit further comprises:

a source of pressurized hydraulic fluid;

a first hydraulic fluid line connecting said source of hydraulic fluid to said first cylinder;

a second hydraulic fluid line connecting said source of hydraulic fluid to said second cylinder; and, a valve means for regulating a flow of hydraulic fluid from said source of hydraulic fluid through said first and second hydraulic fluid lines to actuate a respective piston in each of said first and second cylinders.

11. The vehicle of claim 10 wherein said hydraulic control circuit further comprises a third hydraulic fluid line interconnecting said first and second cylinders.

12. The vehicle of claim 10 wherein said hydraulic control circuit further comprises a fourth hydraulic fluid line connecting said first hydraulic fluid line to a sump and a check valve located in said fourth hydraulic fluid line.

13. The vehicle of claim 6 wherein said means for selectively disabling is so constructed that said overload protection circuit is only operative when said boom arm is within approximately 20 degrees of a line extending perpendicular to a longitudinal centerline of the vehicle, wherein said overload protection circuit comprises a first hydraulic fluid line having one end secured to one of said first and second cylinders between said first and second ends thereof at said preselected point which comprises a port such that when said piston advances past the location of said first hydraulic fluid line, said overload protection circuit is disabled, and wherein a second end of said first hydraulic fluid line is connected to a receptacle for hydraulic fluid.

14. The vehicle of claim 6 wherein the frame's pivot axis is vertically oriented.

15. An actuating mechanism which allows a substantially 180° pivoting motion of a frame, and hence a boom arm secured to the frame, around the frame's pivot axis, the frame being pivotably secured to a vehicle, the actuating mechanism comprising:

a mast to which the frame is fixedly secured, said mast being rotatably secured on one side of the vehicle;

a first hydraulic cylinder having a piston rod end and a cylinder end, one end of said first cylinder being pivotably secured to a first side of said mast and another end being operatively secured to the vehicle;

a second hydraulic cylinder having a piston rod end and a cylinder end, one end of said second cylinder being pivotably secured to a second side of said mast and another end being operatively secured to the vehicle;

a hydraulic overload protection circuit for said first and second hydraulic cylinders, said overload protection circuit having one end in fluid communication with said at least one of said first and second hydraulic cylinders wherein said overload protection circuit engages and disengages depending on an orientation of the boom arm in relation to a longitudinal axis of the vehicle; and, a hydraulic control means connected to said first and second hydraulic cylinders for effecting a linear movement of a piston located in each of said first and second cylinders and hence a pivotal movement of the mast, and the boom arm secured to the frame, about the mast's pivot axis, wherein said control means comprises:

a first hydraulic line communicating at one end with one of said first and second hydraulic cylinders;

a second hydraulic line communication at one end with another of said first and second hydraulic cylinders;

a pump for pressurizing hydraulic fluid; and, a valve interposed in said first and second lines for selectively allowing pressurized hydraulic fluid to flow from said pump to said first and second hydraulic cylinders through said first and second hydraulic lines;

wherein said hydraulic overload protection circuit comprises a third hydraulic fluid line terminating at one end in a port located on said at least one of said first and second hydraulic cylinders, wherein a movement of said piston of said at least one of said first and second hydraulic cylinders in one direction past said port blocks a flow of hydraulic fluid in said hydraulic overload protection circuit thereby disengaging said hydraulic overload protection circuit.

16. The mechanism of claim 15 wherein said hydraulic overload protection circuit comprises at least one pressure control valve.

17. The mechanism of claim 15 wherein said control means further comprises at least one check valve.

18. The mechanism of claim 1, wherein said means for selectively disabling comprises a port located on said first hydraulic cylinder and a piston of said first hydraulic cylinder, a movement of said piston in one direction past said port blocking a flow of hydraulic fluid in said overload protection circuit.

19. The mechanism of claim 1 wherein said means for selectively disabling operates without human intervention.

* * * * *